United States Patent [19]

Baumann

[11] 4,178,627

[45] Dec. 11, 1979

[54] LAMP ASSEMBLY

[75] Inventor: Erwin L. Baumann, Laguna Beach, Calif.

[73] Assignee: Ford Aerospace & Communications Corp., Dearborn, Mich.

[21] Appl. No.: 867,213

[22] Filed: Jan. 5, 1978

[51] Int. Cl.[2] ..... F21V 11/00

[52] U.S. Cl. ..... 362/240; 362/250; 362/251; 362/238

[58] Field of Search ..... 362/236–240, 362/249–252; 339/17 R, 17 LM, 21 R, 22 R

[56] References Cited

U.S. PATENT DOCUMENTS

| | | | |
|---|---|---|---|
| 3,120,351 | 2/1964 | Kirsten | 339/21 R X |
| 3,344,388 | 9/1967 | Parker et al. . | |
| 3,496,518 | 2/1970 | Neumann et al. | 339/21 R |
| 3,527,933 | 9/1970 | Thummel | 339/21 R X |
| 3,566,331 | 2/1971 | Stanback et al. | 339/22 R |
| 3,594,921 | 8/1970 | Wolf . | |
| 3,831,130 | 8/1974 | Valtonen | 339/21 R |
| 3,982,320 | 9/1976 | Buchoff et al. | 339/17 LM |

*Primary Examiner*—Peter A. Nelson

*Attorney, Agent, or Firm*—John J. Roethel; Keith L. Zerschling

[57] ABSTRACT

A lamp assembly in which the lamp housing has a plurality of light bulb sockets and a slot for receiving an electric ribbon cable. The ribbon cable consists of a laminate of dielectric material having a plurality of electrical conductors embedded therein, the conductors having contact surfaces exposed through strategically placed windows in the dielectric material of the ribbon cable. Contact means retained within the housing extend from the exposed contact surface on a specific conductor to a specific light bulb socket.

6 Claims, 6 Drawing Figures

LAMP ASSEMBLY

BACKGROUND OF THE INVENTION

Lamp assemblies utilized on motor vehicles, particularly the rear lamp assemblies, now contain a multiplicity of light bulbs all of which may be housed in a common housing or closely related sub-housings. These bulbs may be individually lighted or may be lighted in various combinations to provide signal and illumination functions. For example, an assembly of rear lamps mounted on the rear end of a vehicle may include a side marker lamp, a back-up lamp, a taillight lamp and a stop light lamp. The light sockets containing the bulbs for the several lamps conventionally are terminated and interconnected using conventional wire harnesses.

It is an object of the present invention to provide a simpler and more versatile method of terminating and interconnecting automotive rear light assemblies.

SUMMARY OF THE INVENTION

The present invention relates to a lamp assembly in which the lamp housing has a plurality of light bulb sockets and a slot for receiving an electric ribbon cable. The ribbon cable consists of a laminate of dielectric material having a plurality of parallel, longitudinally extending, mutually isolated conductors. The ribbon cable has a plurality of windows in its surface to expose and provide access to contact surfaces on the conductors within the cable. Each window is positioned to associate an exposed contact surface on a specific conductor with a specific light bulb socket. Contact means retained within the housing extend from the exposed contact surface on the specific conductor to the specific light bulb socket.

DESCRIPTION OF THE DRAWINGS

Further features and advantages of the present invention will be made more apparent as this description proceeds, reference being had to the accompanying drawings, wherein.

DETAILED DESCRIPTION OF THE INVENTION

Figure 1:
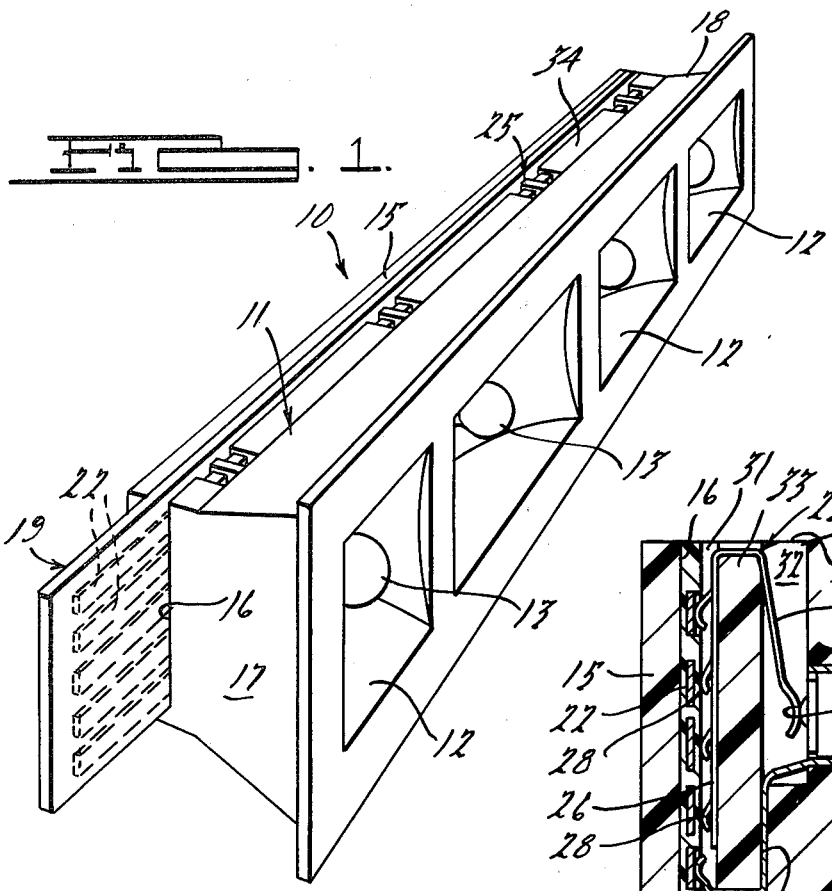
FIG. 1 is a perspective view of a lamp assembly constructed in accordance with a preferred embodiment of the present invention.

Referring now to the drawings, there is shown in FIG. 1 a lamp assembly, generally designated 10. The lamp assembly 10 comprises a plastic housing 11 having a plurality of recesses 12 adapted to receive light bulbs 13. It will be understood that bulb containing recesses will be covered with suitable plastic lenses (not shown). At the bottom of each recess 11, the housing contains a bulb socket of any conventional bulb receiving and retaining configuration. Each socket 14 preferably may be integrated with the housing 11 as the latter is molded from a suitable plastic material.

Figure 2:
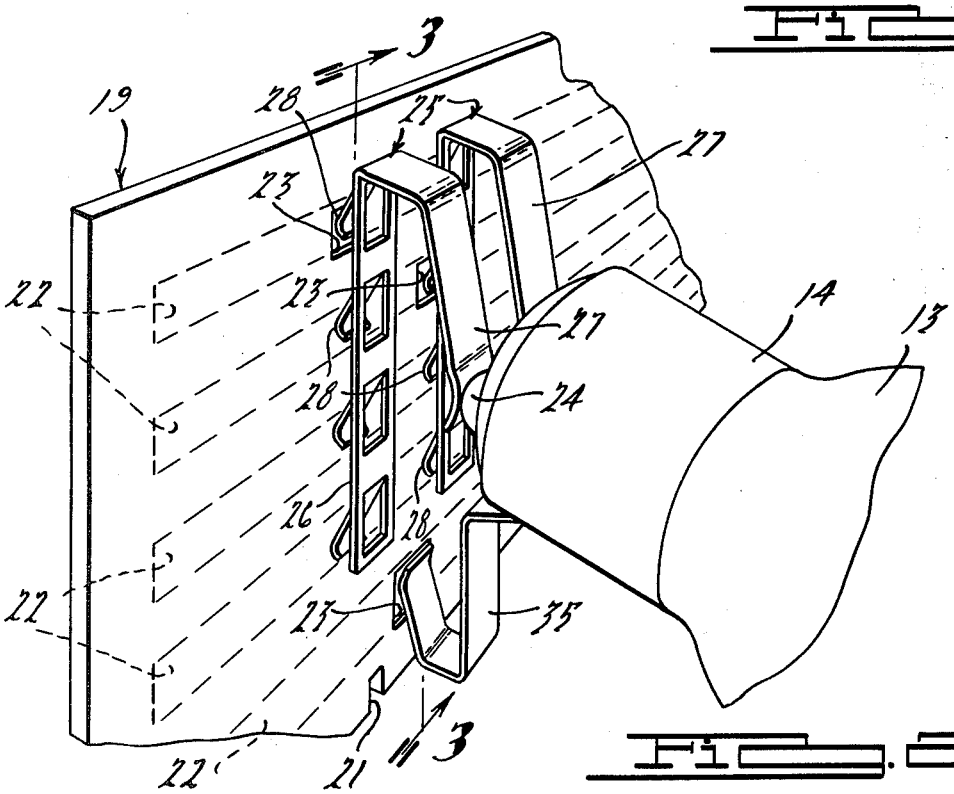
FIG. 2 is an enlarged perspective view of components of lamp assembly less the housing shown in FIG. 1.

The base portion 15, the portion of the housing 11 as viewed in FIGS. 1 and 2, is provided with an elongated slot 16. It will be noted that the light bulb sockets 14 are linearly aligned and that slot 16 extends from one end 17 to the other end 18 of the housing in the direction of alignment of the sockets 14.

An electric ribbon cable 19 is received within the slot 16. In FIG. 1 the ribbon cable 19 is shown partially protruding from the lamp assembly 10. In wholly operative position, however, it snaps into the slot 16 and is longitudinally accurately positioned by key slots 21, see FIG. 2, which fit over locating ribs (not visible) in the floor of the slot. The ribbon cable 19 is a semi-flexible laminate of dielectric material and has a plurality of flat conductors 22 embedded therein. The conductors 22 parallel one another, extend longitudinally of the cable, and are mutually isolated from each other.

Figure 3:
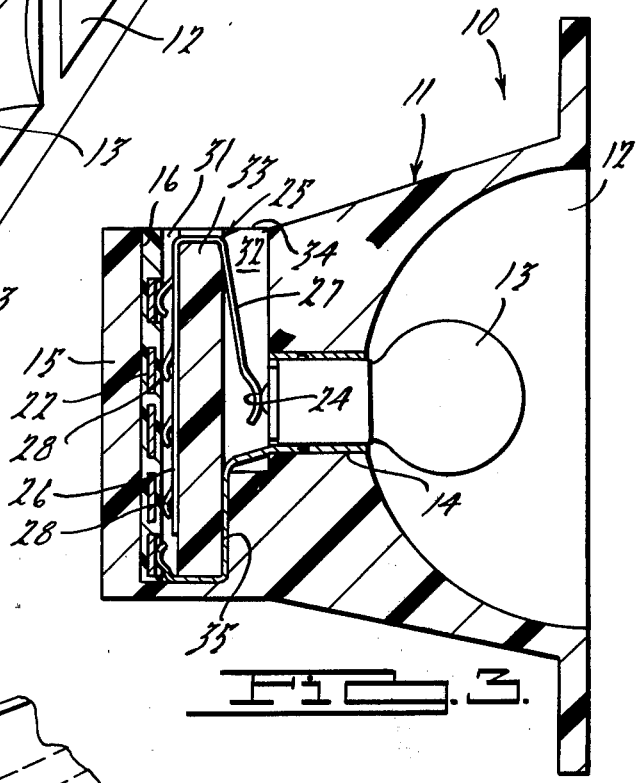
FIG. 3 is a section view on the line 3—3 of FIG. 2.

The ribbon cable 19 has a plurality of windows 23 in one surface, see FIGS. 2 and 3. These windows 23 may be prepunched prior to lamination of the ribbon cable 19 and the location may be varied depending upon lighting requirements, as will be more fully explained. The purpose of the windows is to expose contact surfaces on the several conductors 22. The placement of the windows 23 is designed to associate an exposed contact surface on a specific conductor with a specific light bulb socket. The gap between such exposed contact surface and the contact base 24 of a specific bulb 13 is bridged by a stamped contact element in the form of a reslient, substantially U-shaped metal clip, generally designated 25. The contact elements or clips 25 are best seen in FIG. 2 in which the contact elements are shown as having depending leg portions 26 and 27. The leg 26 has a plurality of outwardly angularly inclined flexible fingers 28 that are adapted to project thru any adjacent window 23 in the ribbon cable 19 to make contact with an exposed contact surface on a conductor 22 within the ribbon cable 19. The leg 27 of the contact element or clip 25 has an arcuate end portion 29 adapted to make contact with the contact end 24 of a bulb 13.

Each contact element 25 is retained in the housing 11 within a pair of recesses 31–32 that are separated by a common wall 33. The recess 31 projects downwardly from the upper surface 34 of the housing 11 substantially to the depth of slot 16 (see FIG. 2). The recess 32 projects downwardly from the top surface 34 of the housing 11 to a point below the bottom edge of the socket 14 to provide clearance for a stepped contact element 35 that projects through the wall 33 and contacts the bottom conductor 22 through a window 23 in the ribbon cable. This bottom conductor 22 is common and is similarly connected to all of the sockets 14 and is connected to the electrical ground for the lamp system. The ground contact elements 35 may be molded in place within the housing 11 at the same time the sockets 14 are integrated with the latter.

In FIG. 3, two contact elements 25 are shown with their depending leg portions 27 abutting the contact base 24 of the bulb 13. This is to show that the construction and arrangment disclosed in FIGS. 1 to 3, inclusive, may be readily adapted for single or multiple filament bulbs.

It should be readily apparent from the foregoing that by judiciously placing windows 23 in the strip or ribbon cable 19 and aligning contact elements 25 so that preselected fingers 28 project through the windows into engagement with the exposed surfaces of the conductors 22, any single or multiple combination of bulbs may be activated.

Figure 4:
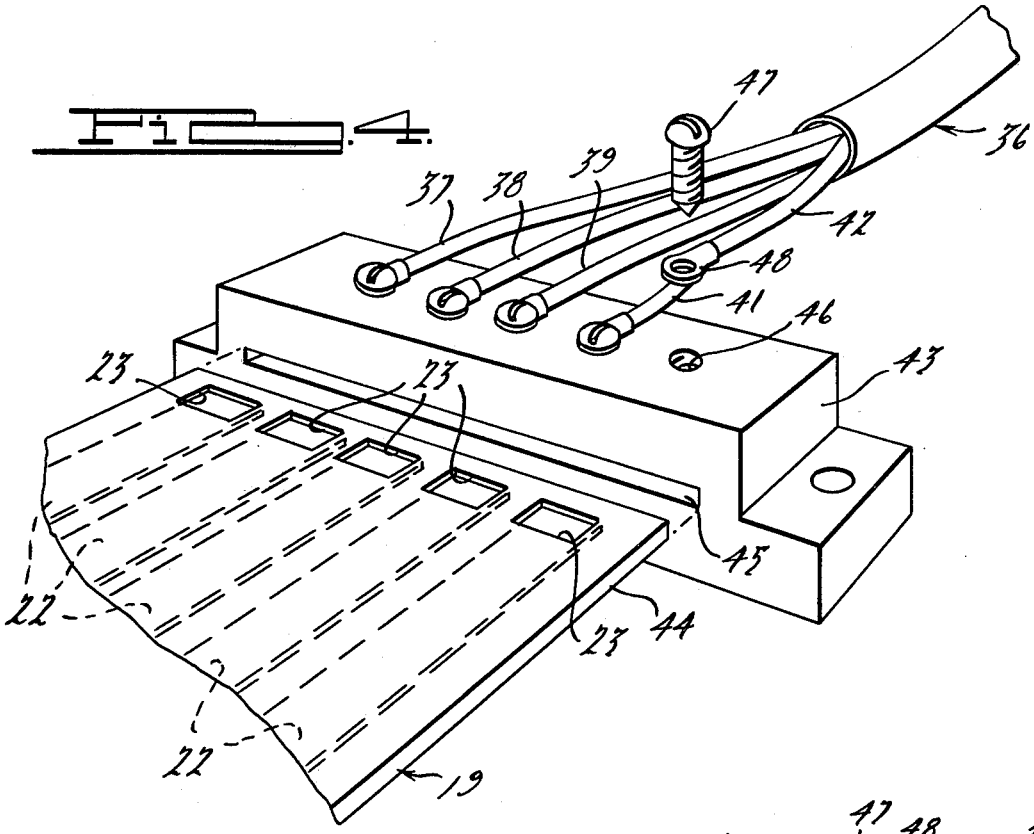
FIG. 4 is an enlarged view of a connecting means for connecting the lamp assembly of FIG. 1 to a conventional wiring harness.
Figure 5:
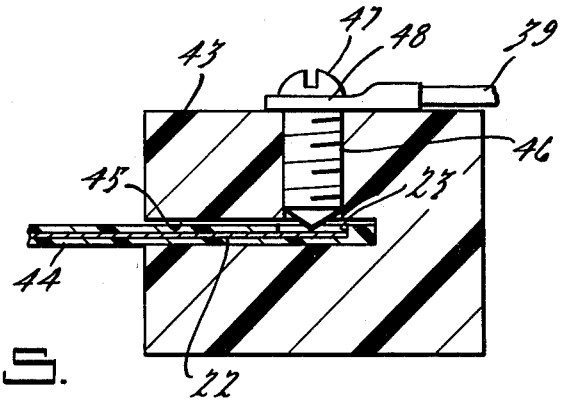
FIG. 5 is a vertical section view through the connection means of FIG. 4 illustrating an embodiment of the latter.

With reference to FIG. 4, the ribbon cable conductors 22 may be connected to a conventional wiring harness 36 having wires leading to various switches (not shown) leading to a source of electric current. For example, wire 37 may lead to a switch controlling the turn signal lamps on the vehicle, wire 38 to the stoplight switch, wire 39 to the taillight, wire 41 to the back-up lamp, and wire 42 to the electrical ground.

The wiring harness 36 preferably is coupled to the ribbon cable 19 through a transition block 43 adapted to be positioned at either end of the housing 11. One end 44 of the strip or ribbon cable 19 may be provided with a plurality of laterally aligned windows 23. The end 44 of ribbon cable 19 is inserted in a slot 45 and the windows 23 are aligned with threaded holes 46 in the transition block 43. Metal screws 47 project through eyelets 48 on the ends of the several wires from wiring harness 36, through the screw holes 46 and into engagement with the exposed conductor surfaces of the conductors 22.

Figure 6:
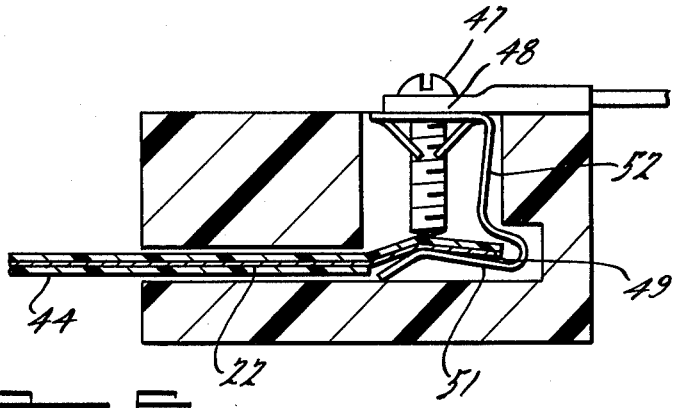
FIG. 6 is a view in part similar to FIG. 5 illustrating an alternate embodiment of the connection means.

FIG. 6 discloses an alternate arrangement for bridging the electrical gap between the ribbon cable 19 and the wires of the wiring harness 36. In this embodiment, the ribbon cable end 49 has exposed conductors 22 which engage a base leg 51 of a clip 52 provided at its upper end 53 with screw receiving spring fingers 54 through which a screw 47 may be threaded. The screw tip forces the exposed conductor surface into engagement with the base leg 51 of a spring clip 52.

It will be understood that the invention is not to be limited to the exact construction shown and described, but that various changes and modifications may be made without departing from the spirit and scope of the invention, as defined in the appended claims.

I claim:

1. A lamp assembly comprising:
a lamp housing having a plurality of light bulb receiving sockets,
an electric ribbon cable,
an elongated slot means in the housing receiving the ribbon cable,
the ribbon cable consisting of a laminate of dielectric material having a plurality of parallel, longitudinally extending, mutually isolated, electrical conductors embedded therein,
the ribbon cable having a plurality of windows in its surface to expose contact surfaces on the conductors,
key slot means longitudinally locating the ribbon cable in the elongated slot means to align each window and thereby a related exposed contact surface with a specific light bulb socket,
and contact means retained within the housing extending from the exposed contact surface on the specific conductor to the specific light bulb socket.

2. A lamp assembly according to claim 1, in which: the light bulb sockets are linearly aligned.

3. A lamp assembly according to claim 1, in which:
the lamp housing is molded from an electrically nonconductive plastic,
and the contact means comprises a plurality of U-shaped resilient metal contact elements,
the housing having a plurality of spaced pairs of recesses with each pair having a common wall between its individual recesses,
one of the recesses of each pair being in communication with the slot means receiving the ribbon cable and the other being in communication with a light bulb socket,
and a contact element straddles the common wall between individual recesses to electrically bridge the gap between a conductor and a light bulb.

4. A lamp assembly according to claim 3, in which:
each U-shaped resilient metal contact element has a first and second leg portion,
the first leg portion extending into the one recess and having a plurality of fingers adapted to project through any adjacent window providing access to an exposed contact surface,
and the second leg portion extending into the other recess and having a terminal portion engageable with the contact end of a bulb in the bulb socket.

5. A lamp assembly comprising:
a lamp housing molded from an electrically nonconductive plastic and having a plurality of light bulb receiving sockets,
an electric ribbon cable,
an elongated slot means in the housing receiving the ribbon cable,
the ribbon cable consisting of a laminate of di-electric material having a plurality of parallel, longitudinally extending, mutually isolated, electrical conductors embedded therein,
the ribbon cable having a plurality of windows in its surface to expose contact surfaces on the conductors,
each window being positioned to associate an exposed contact surface on a specific conductor with a specific light bulb socket,
and contact means retained within the housing extending from the exposed contact surface on the specific conductor to the specific light bulb socket,
the contact means comprising a plurality of U-shaped resilient metal contact elements,
the housing having a plurality of spaced pairs of recesses with each pair having a common wall between its individual recesses,
one of the recesses of each pair being in communication with the slot means receiving the ribbon cable and the other being in communication with a light bulb socket,
and a contact element straddles the common wall between individual recesses to electrically bridge the gap between a conductor and a light bulb.

6. A lamp assembly according to claim 5, in which:
each U-shaped resilient metal contact element has a first and second leg portion,
the first leg portion extending into the one recess and having a plurality of fingers adapted to project through any adjacent window providing access to an exposed contact surface,
and the second leg portion extending into the other recess and having a terminal portion engageable with the contact end of a bulb in the bulb socket.

* * * * *